United States Patent [19]

Svagr

[11] Patent Number: 4,962,657

[45] Date of Patent: Oct. 16, 1990

[54] ROLLING MILL TRAIN, PARTICULARLY ROLLING MILL TRAIN IN A SECTION MILL

[75] Inventor: Alexander Svagr, Hilden, Fed. Rep. of Germany

[73] Assignee: SMS Schloemann-Siemag Aktiengesellschaft, Dusseldorf, Fed. Rep. of Germany

[21] Appl. No.: 314,431

[22] Filed: Feb. 22, 1989

[30] Foreign Application Priority Data

Feb. 22, 1988 [DE] Fed. Rep. of Germany ..... 3805476

[51] Int. Cl.[5] ..... B21B 31/08

[52] U.S. Cl. ..... 72/238; 72/234; 72/250

[58] Field of Search ..... 72/234, 238, 239, 250

[56] References Cited

U.S. PATENT DOCUMENTS

| | | | |
|---|---|---|---|
| 3,136,182 | 6/1964 | Wegmann et al. | 72/238 |
| 3,611,779 | 10/1971 | Simmonds | 72/239 |
| 3,712,102 | 1/1973 | Eibe | 72/238 |
| 3,747,387 | 7/1973 | Shumaker | 72/239 |
| 4,522,051 | 6/1985 | Hayashi et al. | 72/239 |
| 4,686,845 | 8/1987 | Svagr | 72/238 |

FOREIGN PATENT DOCUMENTS

| | | | |
|---|---|---|---|
| 55-24771 | 2/1980 | Japan | 72/239 |

*Primary Examiner*—Lowell A. Larson
*Assistant Examiner*—Thomas C. Schoeffler
*Attorney, Agent, or Firm*—Toren, McGeady & Associates

[57] ABSTRACT

A rolling mill train, particularly a rolling mill train in a section mill with at least one group of rolling mill stands including n stands in a group. The rolling mill stands have at least horizontal guide members which are arranged at least on the middle stands spaced closely together in the pitch line. Every other rolling mill stand of the group of stands is constructed so as to be displaceable from the pitch line by at least the width of the guide member for the purpose of exchanging the guide members and/or the rolls. The adjacent rolling mill stands may be arranged stationary in the pitch line. Also disclosed is a method for controlling the exchange of the stands in the rolling mill train.

14 Claims, 3 Drawing Sheets

ROLLING MILL TRAIN, PARTICULARLY ROLLING MILL TRAIN IN A SECTION MILL

BACKGROUND OF THE INVENTION

1. Field of the Invention

The present invention relates to a rolling mill train. The invention particularly relates to a rolling mill train in a section mill with at least one group of rolling mill stands including n stands in a group. The rolling mill stands have at least horizontal guide members which are arranged at least on the middle stands spaced closely together in the pitch line.

The present invention also relates to a method for controlling the exchange of the stands in the above-described rolling mill train.

2. Description of the Related Art

The overall technical design of the combined section mills is important for the economical operation of the rolling mill and for the efficient manufacture of section steel of different shapes and sized. Substantially mechanized changing systems for rolling mill stands, rolls and guide members for the rolling mill stands are of particular importance for a cost-effective adjustment of the rolling mill train to different rolling schedules with different lot sizes.

In order to make it possible to utilize a rolling mill train for periods which are as long as possible, it has already been proposed to displace complete mill stands by means of manipulators or sliding platforms and snatch-type couplings from the rolling mill train onto separate sites and to replace the rolling mill stands by a rolling mill stand which has been adapted to the respective rolling schedule. The replacement rolling mill stand can be prepared on the separate site and can be moved into the rolling mill train by means of the manipulator. The use of replacement stands further makes it possible to arrange any chosen rolling systems one behind the other.

The above-described features provide the possibility of changing from one universal schedule to another or from a universal rolling mill operation to a two-high rolling operation or vice-versa. The time required for a quick change in schedules was substantially reduced. However, the replacement stands have the disadvantage that they require high investments and that many couplings are required which are medium-operated or electrically operated and are susceptible to trouble.

It is further known from European patent 2047 to move even heavy rolling mill stands quickly and in a structurally simple manner over long displacement distances during the exchange of stands. For this purpose, the rolling mill stand has its own drive which is operationally connected to rollers on which the stand can be moved along tracks directly into the pitch line or out of the pitch line.

For adjusting the rolling mill stands to different rolling schedules, it is also known to move complete sets of rolls transversely of the rolling line out of the rolling mill stands which are arranged stationary in the rolling mill stand. For this purpose, the guide members guiding the rolling material are disassembled. This is done by means of overhead trains or auxiliary trains. However, the disassembly, the assemly and the alignment of the guide members is very time-consuming and labor intensive. The reason for this is that the access to guide members is very difficult because of the narrow space available.

Therefore, the primary object of the present invention is to provide a rolling mill train of the above-described type in which the adjustment to different rolling schedules can be carried out more efficiently than in the past. This is to be achieved primarily by a substantial mechanization of the exchange of rolls and of guide members of the rolling mill stand, so that the time and personnel required for the change are reduced. In addition, the potential danger to the personnel during the roll change is to be reduced and the number of replacement stands is to be reduced.

SUMMARY OF THE INVENTION

In accordance with the present invention, every second rolling mill stand of the group of stands is constructed so as to be displaceable from the pitch line by at least the width of the guide member for the purpose of exchanging the guide members and/or the rolls. The adjacent rolling mill stand may be arranged stationary in the pitch line.

For example, in a group of rolling mill stands with three stands, the stand in the middle is displaced toward the operator side to such an extent that sufficient space is created for pulling the guide members from the rolling mill stand and to mount new guide members on the rolling mill stands.

In accordance with an advantageous feature of the invention, in a group of reversing tandem stands including a universal stand, an edging stand and another universal stand the edging stand is constructed so as to be displaceable toward the operator side by at least half the width of the universal stand. Thus in a group of stands which includes two heavy universal stands, the smallest stand, i.e., the edging stand, is moved toward the operator side only to such an extent as is made necessary by the narrow space available between the two heavy universal stands. As soon as the edging stand has reached a displacement position which is located outside of half of the width of the universal stand, the edging stand is easily accessible from all sides and the guide members can be easily and quickly exchanged. The displacement of the edging stand from the pitch line creates a free space between the universal stands in which assembly and disassembly devices can be utilized which make it possible to quickly and inexpensively replace the guide members of the universal stands.

In accordance with an advantageous further development of the invention, the edging stand is displaceable from the pitch line toward the operator side by means of rollers which each have their own drive. In this manner, the rolling mill stand can quickly travel the displacement distance thereof without requiring special displacement rods or hydraulic units for displacement.

The chocks of the rolling mill stands carrying the horizontal rolls are advantageously displaceable on rollers having their own drive from the edging stand or from the universal stand. As soon as the guide members have been pulled off the rolling mill stand, the rolls supported in the chocks can be displaced from the rolling mill stand to a separate site without requiring large apparatus. For adapting the rolling mill train to a new rolling schedule, it is also easily and simply possible to place and fix new rolls in the rolling mill stands. When the rolling mill stands are in the assembly position in which they are offset relative to each other, it is easily and quickly possible to place new or newly adjusted guide members thereon. As is clear from the above, the features of the present invention substantially reduce the assembly requirements and expensive replacement stands are entirely unnecessary.

In order to further mechanize the exchange of guide members in a group of rolling mill stands, it is proposed in accordance with the present invention that the edging stand has on the drive side thereof at least one movable assembly platform. The assembly platform advantageously has a length in the direction of the pitch line which corresponds approximately to the spacing between the universal stands and the width of the platform corresponds approximately to the displacement distance of the edging stand. As a result of this feature, the guide members can be removed from both universal stands on a single assembly platform because the assembly platform is moved between the universal stands by the same distance as the edging stand is moved out of the pitch line. The new guide members can also be advantageously assembled on the universal stands from the assembly platform.

In accordance with another advantageous feature, a stationary work platform is arranged on both sides of the displaced edging stand on the operator side, so that the guide members can be removed from the edging stand and the edging stand can be equipped with new guide members in a particularly advantageous manner and simultaneously with the exchange of the guide members on the universal stands.

In accordance with a particularly advantageous further development of the invention, the assembly platform and the work platform each have at least one installation group including at least one guide member premounted in a stand and a scaffold preferably arranged next to the stand with the premounted guide member. Thus, the time required for exchanging the guide members is even further reduced, particularly if the guide members are preassembled as a structural unit on the assembly platform. The guide members can be disassembled on the assembly platform or work platform by means of the scaffold without requiring overhead cranes or auxiliary cranes. Immediately subsequently, the preassembled guide member can be inserted into he rolling mill stand. For example, the scaffold may be a movable carriage.

The exchange of guide members in a group of rolling mill stands becomes even more efficient when preferably automatically operated pulling-off devices and assembly devices for the guide members are arranged on the assembly platform and on the work platform, so that the use of personnel can be even more reduced in the areas where there is a security risk.

In accordance with a special further development of the invention, the edging stand is connected to at least one position indicator which limits the displacement distance of the stand, wherein the connection is effected in such a way that the scaffold on the assembly platform can be moved approximately centrically toward the guide members of the universal stand and the scaffold on the work platform can be moved approximately centrically toward the guide members of the edging stand. This makes possible a substantially automated exchange of stands or exchange of guide members because an automated program control can initiate the displacement of the edging stand from the pitch line and the displacement is stopped by means of the position indicator exactly at the point where the disassembly of the guide members on the work platform or on the assembly platform is to be carried out by means of the automatically operating pulling-off device. For the same reason, it is advantageous to connect the edging stand to at least one position indicator which limits the displacement distance, wherein the connection is effected in such a way that the guide member preassembled on the assembly platform can be moved approximately centrically toward the universal stand in the pitch line and the guide member preassembled on the work platform can be moved approximately centrically toward the edging stand.

The method according to the present invention for controlling the exchange of stands in a rolling mill train includes moving the edging stand step by step from the pitch line and initially controlling the position indicator for the position of the scaffold for disassembling the guide members of the rolling mill stands and subsequently controlling the position indicator for the preassembly position for assembling the preassembled guide member on the rolling mill stands before moving the edging stand back into the pitch line.

By means of a suitable program control and by means of the position indicator which may be limit switches or contactless time switches, the guide member exchange in a group of stands or in a universal stand train can be substantially automated, so that the time required in the past for exchanging the guide members in the stands of one hour is reduced to approximately ten minutes.

In accordance with a further development of the control method of the invention, the position indicator for the scaffold position releases the locking means for the rolls of the stands mounted in the chocks and the position indicator for the preassembled position closes the locking means. As a result, a fully automated exchange system for the rolls and for the guide members in a group of stands has been provided, particularly in conjunction with chocks whose drives, particularly hydraulic drives, can be switched on and off in dependence on the locking of the chocks in the rolling mill stands.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DESCRIPTION OF THE PREFERRED EMBODIMENT

Figure 1:
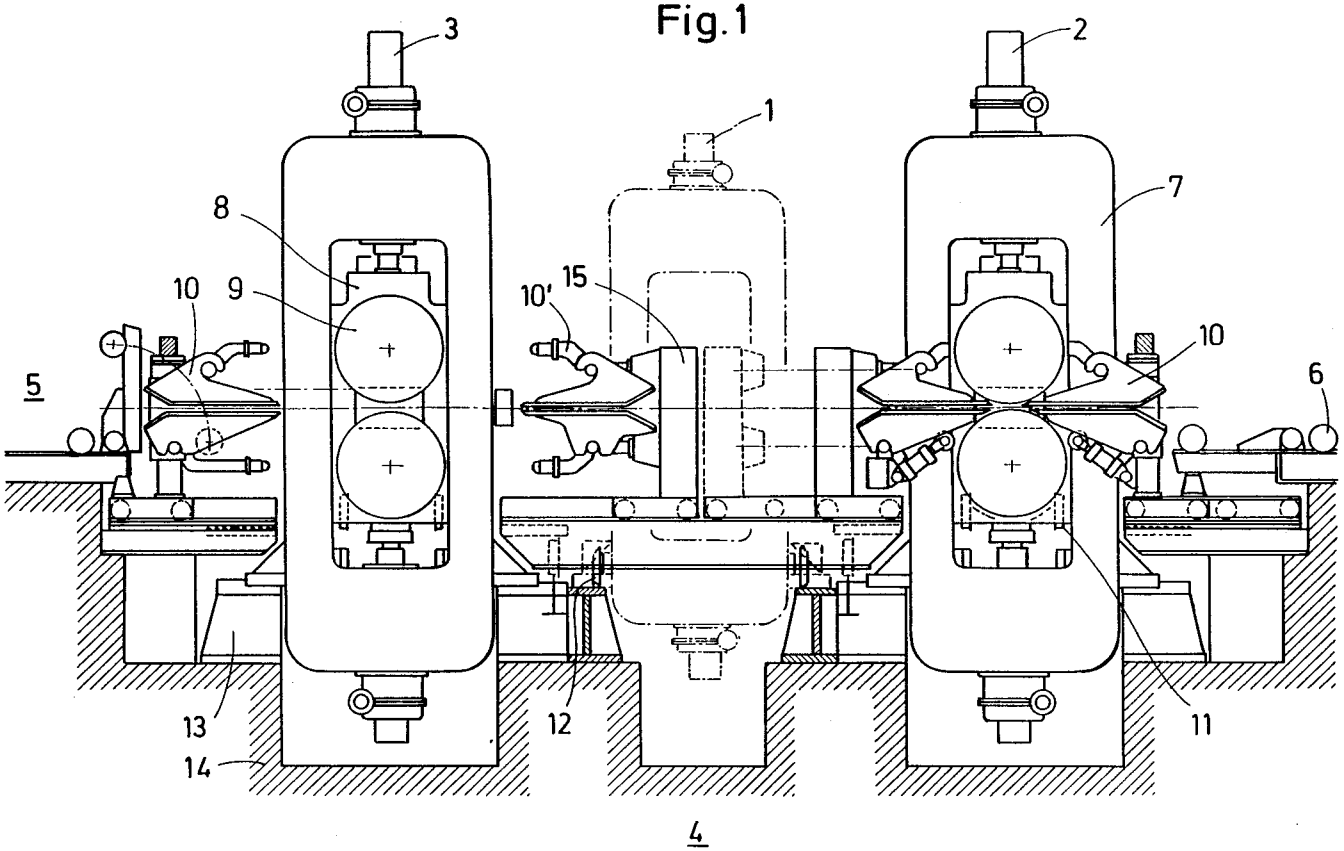
FIG. 1 is a partially sectional view of a group of rolling mill stands in a universal stand train with a universal stand, a displaced edging in the middle and another universal stand.

FIG. 1 of the drawing shows an edging stand 1 and two universal stands 2, 3 which form a group 4 of rolling mill stands. The group 4 is arranged in a section mill 5. The smaller edging stand 1 is arranged between the two larger universal stands 2, 3. A roller conveyor 6 which transports the rolling material, for example, a T-shaped beam, is arranged on both sides of the universal stands 2, 3.

Horizontal rolls 9 are mounted in chocks 8 of each rolling mill stand 7 of the group 4 of rolling mill stands. Guiding members 10 for guiding the rolling material are mounted in the region of the roll gap between the horizontal rolls. The chocks 8 supporting the horizontal rolls are mounted on rollers 11 which each have their own drives which may be, for example, a commercially available hydraulic wheel hub drive. The above-mentioned components are of the same type in the edging stand 1 and the universal stands 2, 3, so that the same reference numeral applies to corresponding structural components.

The edging stand 1 is mounted on support rollers 12 which each have their own drive. The roller drives may also be commercially available hydraulic wheel hub drives as they are used in the rollers for the chocks 8. The edging stand 1 and the universal stands 2, 3 are mounted on base plates 13 which, in turn, are connected to the foundation 14. The rolling mill stands within the group 4 are placed so closely together that it appears that the guide members contact each other in the pitch line in order to provide as uninterrupted a guidance for the rolling material as possible. The guide members 10 of the universal stand 3 are shown disassembled by means of the pulling-off device 15.

Figure 2:
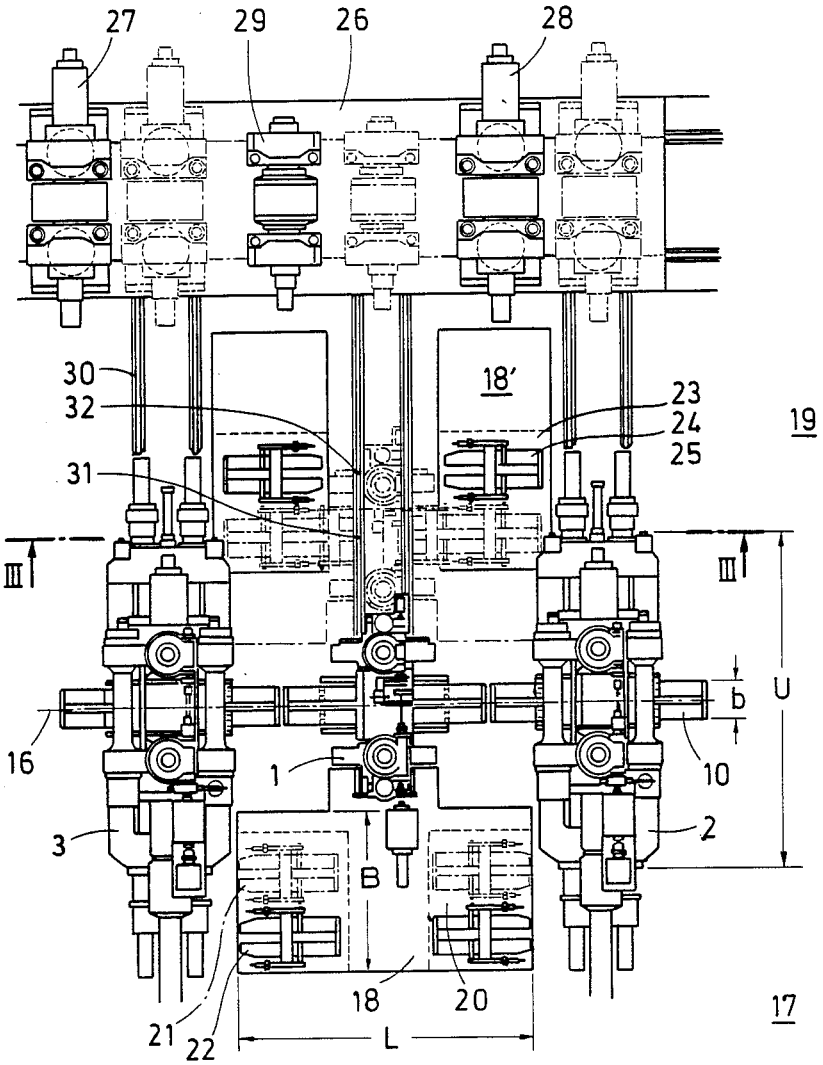
FIG. 2 is a top view, on a smaller scale, of the group of stands shown in FIG. 1 including an assembly platform and a work platform for the exchange of guide members and with displacement platforms for the rolls.

FIG. 2 of the drawing is a top view, on a smaller scale, of the group 4 including universal stand 2, edging stand 1 and universal stand 3. As can also be seen in FIG. 2, the guide members 10 are arranged very closely together in the direction of pitch line 16.

The edging stand 1 has on the drive side 17 an assembly platform 18 which preferably can be moved together with the stand. As seen in the direction of pitch line 16, the assembly platform 18 has a length L which corresponds approximately to the distance between the universal stands 2, 3. The assembly platform 18 has a width B which corresponds approximately to the displacement distance of the edging stand.

The universal stands 2, 3 of the group 4 are mounted stationary in the rolling mill train 5. The edging stand 1, on the other hand, can be moved from the pitch line 16 toward the operator side 19. The displaced position of the edging stand 1 is shown in FIG. 2 in broken lines. As is evident from the drawing, the edging stand 1 is displaced from the pitch line 16 approximately by half the width U of the universal stand 2. A work platform 18, each is provided on both sides of the displaced edging stand 1.

An installation group 20 each for the guide members 10 of the universal stands 2, 3 are mounted on the assembly platform 18 opposite the respective universal stands 2, 3. The installation group 20 for the assembly and disassembly of the guide members 10 and the supports 10, thereof includes a scaffold 21 for a guide member shown in broken lines and a guide member 22 preassembled on a stand. On each work platform 18, is mounted an installation group 23 which includes a guide member 24 for the edging stand 1 preassembled in the stand and a corresponding scaffold 25 arranged next to the stand.

Adjacent the work platforms 18, is provided an installation site 26 on which the sets of rolls 27, 28 for the universal stands 2, 3 and the set of rolls 29 for the edging stand 1 are prepared. On a displacement platform provided with rails 30, the sets of rolls 27, 28, 29 of the group of stands are moved from the stands towards the installation site 26 to the rolling mill stands. The displacement of the rolling mill stands is effected by means of separate roller drives 11.

When the edging stand 1 is moved from the pitch line 16 toward the installation side 19 by means of the position indicator 31 by half the width U of the universal stand 2 into the position shown in FIG. 2 in broken lines, the scaffolds 21 are placed on the assembly platform 18 in longitudinal direction relative to the guide members 10 of the universal stands 2, 3 and the scaffold 25 is placed on the work platform 18, in longitudinal direction relative to the guide members 10 of the edging stand 1.

When the edging stand is in this displaced position, the guide members ca be pulled out of the universal stand by means of the preferably automatically operated pulling-off devices 15. Simultaneously, the guide members can be pulled out of the edging stand. The guide members can then be placed on the assembly platform 18 and the work platform 18'.

Figure 3:
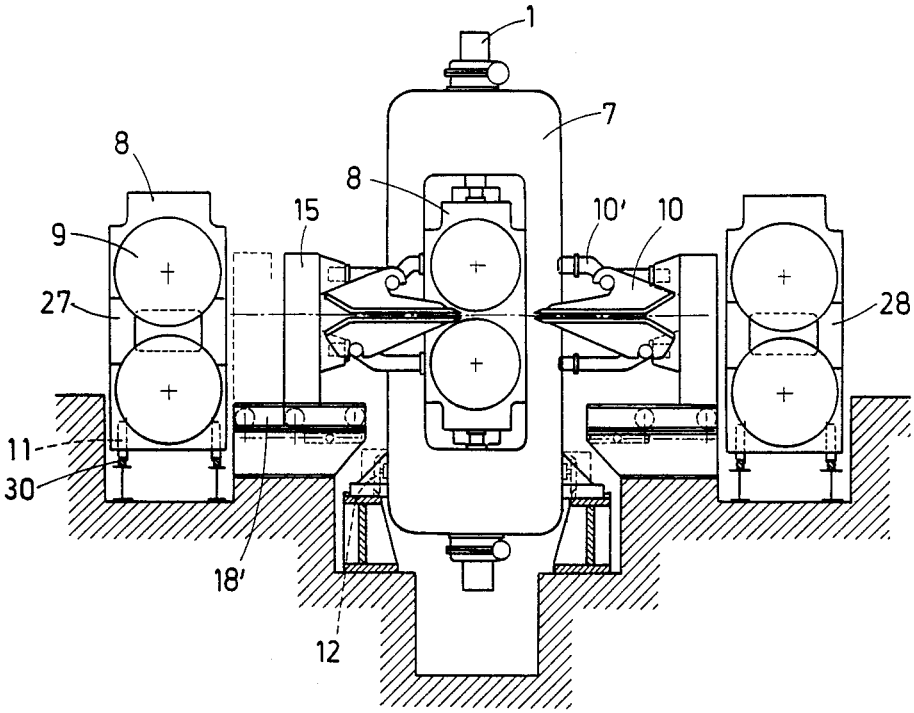
FIG. 3 is a sectional view along sectional line III—III of FIG. 2 showing the displaced edging stand and the rolls displaced from the stands.

The displaced assembly position of the edging stand 1 is shown in FIG. 3. FIG. 3 also shows the pulling-off devices 15 or mounting devices 15 in the position in which the guide members 10 are disassembled on the work platform 18, and in the position in which the guide members 10 are mounted on the chocks 8. The rolls 9 of the universal stands 2, 3 can be displaced along the work platform by means of the roller drive 11.

When the sets of rolls 27, 28, 29 of the entire group 4 of stands are to be exchanged, the position indicator 31 can release the locking means, not shown in detail, for the rolls mounted in the chocks, so that the sets of rolls can be moved toward the installation site 26 by means of the driven rollers 11 n the rails 30 of the displacement platform. The new sets of rolls for the rolling mill stands are moved from the installation site 26 on the rails 30 of the displacement platform into the stands and are adjusted in the stands in the known manner.

Subsequently, the edging stand 1 is displaced by means of the support roller drive 12 into a ne assembly position which is controlled by the position indicator 32 in such a way that the guide member 22 preassembled on the assembly platform 18 is moved approximately centrically to the universal stands 2, 3 and, simultaneously, the guide member 24 preassembled on the work platform 18' is placed approximately centrically in front of the rolls of the edging stand. In this assembly position of the edging stands, the preassembled guide members 22, 24 are connected by means of the automatically operated assembly devices 15 with the edging stand 1 or the universal stands 2, 3. Simultaneously, the appropriate locking means of the sets of rolls in the stands can be controlled by means of the position indicator 32. Subsequently, the edging stand 1 is moved back from the operator side 19 to the pitch line 16, so that the entire group of stands is ready for rolling a rolled product with a different sectional shape.

The above-described measures for substantially mechanizing and automating the exchange of rolls and guide members in a group of stands of a section mill make it possible to reduce the time and personnel required for the disassembly, the assembly and the alignment of the guide members and for the exchange of rolls of the individual stands to a fraction of the time and personnel required previously.

While a specific embodiment of the invention has been shown and described in detail to illustrate the application of the inventive principles, it will be understood that the invention may be embodied otherwise without departing from such principles.

I claim:

1. In a rolling mill train in a section mill with at least one group of rolling mill stands including n stands in a group and middle stands in the group, the rolling mill stands being arranged in a pitch line and having horizontal guide members which are arranged at least on the middle stands spaced closely together in the pitch line, wherein the improvement comprises that the group of stands is a reversing tandem stand group including a first universal stand, an edging stand and a second universal stand, the edging stand being configured to be displaceable for the purpose of exchanging the guide members and the rolls from the pitch line by at least the width of a guide member, wherein a stationary work platform is arranged on the operator side on both sides of the edging stand when the edging stand is in the displaced position and wherein the edging stand has on a drive side of the rolling mill train at least one assembly platform which is displaceable with the edging stand.

2. The rolling mill train according to claim 1, wherein the edging stand is displaceable toward an operator side of the group by at least half the width of the universal stands.

3. The rolling mill train according to claim 2, wherein the edging stand is displaceable from the pitch line toward the operator side by means of rollers, wherein each roller is provided with a drive.

4. The rolling mill train according to claim 3, wherein each stand has horizontal rolls and chocks for supporting the horizontal rolls, each chock being provided with rollers, each roller having a drive, the chocks being displaceable from the stands by means of the rollers.

5. The rolling mill train according to claim 4, wherein the assembly platform has a length in direction of the pitch line which corresponds approximately to the spacing between the first and second universal stands, and wherein the assembly platform has a width which corresponds approximately to the displacement distance of the edging stand.

6. The rolling mill train according to claim 5, wherein the assembly platform and each work platform each have at least one installation group, the installation group including at least one stand carrying a guide member premounted thereon and a scaffold arranged next to the stand with the premounted guide member.

7. The rolling mill train according to claim 6, wherein the installation group on the assembly platform carries the guide members for the universal stands and the installation group on each work platform carries the preassembled guide member for the edging stand.

8. The rolling mill train according to claim 5, wherein automatically operated pulling-off and mounting devices for the guide members are arranged on the assembly platform and on the work platforms.

9. The rolling mill train according to claim 8, wherein the edging stand is connected to a position indicator limiting the displacement path thereof, such that the guide member preassembled on the assembly platform is movable in the pitch line towards the universal stand and the guide member preassembled on each work platform is movable approximately centrically toward the edging stand.

10. The rolling mill train according to claim 9, wherein the position indicator is connected to locking means for the rolls of the stands mounted in the chocks.

11. The rolling mill train according to claim 5, wherein the edging stand is connected at least to one position indicator limiting the displacement path thereof, such that a scaffold on the assembly platform is movable approximately centrically toward the guide members of the universal stands and a scaffold on each work platform is movable approximately centrically toward the guide members of the edging stand.

12. The rolling mill train according to claim 11, wherein the position indicator is connected to locking means for the rolls of the stands mounted in the chocks.

13. In a method for controlling the exchange of stands in a rolling mill train, the rolling mill train including an edging stand and universal stands, the stands being arranged in a pitch line and having horizontal guide members, a movable assembly platform being arranged on a drive side of the rolling mill train and a stationary work platform each being arranged on both sides of the edging stand on an operator side when the edging stand is in a displaced position, the edging stand being connected to a first position indicator which limits the displacement distance thereof such that a scaffold on the assembly platform is movable approximately centrically toward the guide members of the universal stand and a scaffold on each work platform is movable approximately centrically toward the guide members of the edging stand, the edging stand being connected to a second position indicator which limits the displacement distance thereof such that a guide member preassembled on the assembly platform is movable in the pitch line toward the universal stand and a guide member preassembled on each work platform is movable approximately centrically toward the edging stand, the improvement comprising moving the edging stand step by step from the pitch line and initially controlling the first position indicator for placing the scaffold in position for disassembling the guide members from the rolling mill stands and subsequently controlling the second position indicator for placing a preassembled guide member in position relative to the stand for mounting the preassembled guide member in the stand, and returning the edging stand to the pitch line.

14. The method according to claim 13, wherein the first position indicator opens a closing means for rolls mounted in chocks of the stands and the second position indicator closes the locking means.

* * * * *